US005421570A

United States Patent [19]

Hube et al.

[11] Patent Number: 5,421,570

[45] Date of Patent: Jun. 6, 1995

[54] CARTRIDGE FOR FEEDING OVERSIZED PAPER STOCK FROM A STANDARD SIZE TRAY

[75] Inventors: Randall R. Hube, Rochester; Michael E. Farrell, Fairport, both of N.Y.

[73] Assignee: Xerox Corporation, Stamford, Conn.

[21] Appl. No.: 10,205

[22] Filed: Jan. 28, 1993

[51] Int. Cl.[6] ..... B65H 1/00

[52] U.S. Cl. ..... 271/145; 271/161

[58] Field of Search ..... 271/161, 145; 221/197, 221/287

[56] References Cited

U.S. PATENT DOCUMENTS 5,145,163 9/1992 Cowan et al. ..... 271/161

FOREIGN PATENT DOCUMENTS 61-254430 11/1986 Japan ..... 271/161

336122 2/1991 Japan ..... 271/145

*Primary Examiner*—David H. Bollinger

*Attorney, Agent, or Firm*—Fay, Sharpe, Beall, Fagan, Minnich & McKee

[57] ABSTRACT

A cartridge for feeding paper stock to a copier or printer. The cartridge functions by creating a folded stack of paper. The cartridge, when inserted into the tray of a copier or printer, has an opening in communication with the discharge outlet of the tray to allow the folded paper access to the copier or printer.

21 Claims, 4 Drawing Sheets

CARTRIDGE FOR FEEDING OVERSIZED PAPER STOCK FROM A STANDARD SIZE TRAY

BACKGROUND OF THE INVENTION

1. Field of the Invention

This invention relates to a cartridge inserted into a printer or copier paper tray. Particularly, the invention relates to a cartridge which is placeable into a standard sized paper stock feeding tray which will allow the use of oversized paper stock in the standard sized tray. The invention more particularly relates to a cartridge which folds the oversized paper stock to allow its insertion into a standard sized paper tray.

2. Description of the Art

Most printers and copiers, in particular, but not exclusively xerographic or like copiers, utilize more than one paper stock to provide a variety of duplication functions. These printers and copiers may have one or more trays that can accommodate standard size stock (media). However, printers and/or copiers are often equipped with only one tray to accommodate oversized paper stock. For example, the Xerox 5090 copy machine is designed with two standard size trays, but only one oversized paper tray. To duplicate originals in a job that requires two oversized paper stocks in the output, the operator must either run the job uncollated and reload the oversized tray at different points during the job or partition the job by stock characteristics, run in uncollated mode and collate off-line. Each of these operations is inefficient. An additional tray to provide a second oversized paper stock is the obvious solution to the dilemma. However, adding another oversized tray would require major and costly redesign of the printer or copier. Accordingly, it is desirable in this art to provide a means of copying or printing multiple oversized (large) paper sizes without costly retooling of the above-identified equipment. Therefore, it would be preferable to utilize the standard sized tray of the copy machine or printer to feed oversized paper stock.

SUMMARY OF THE INVENTION

Accordingly, it is a primary object of this invention to provide a new cartridge for feeding oversized paper stock.

A further object of this invention is to provide a new cartridge for feeding oversized paper stock which can be accommodated by a standard size paper feed tray.

Additional objects and advantages of the invention will be set forth in part in the description which follows and in part will be obvious from the description or may be learned by practicing the invention. The objects and advantages of the invention may be realized and attained by means of the instrumentalities and combinations particularly pointed out in the appended claims.

To achieve the foregoing objects and in accordance with the purpose of the invention, as broadly described herein, the cartridge of this invention comprises a housing having an outlet opening which can be positioned in alignment with the discharge opening of a paper feeding tray. The cartridge is formed such that a stack of sheet stock is positioned with one edge located at or passing through the outlet opening. The stack of sheet stock is folded upon itself and enclosed in the cartridge housing. A means is provided in the housing for maintaining the sheet stock in an aligned and folded position while allowing removal of successive sheets from the sheet stock through the housing outlet and subsequently the discharge opening.

Preferably, the cartridge assembly will hold the sheet stock in a C or S-shaped pattern. More preferably, the cartridge assembly will hold the sheet stock in a J-shaped pattern.

It is also preferred that the cartridge assembly include an internal guide for maintaining the stack of sheet stock in a folded and aligned position. More preferably, the internal guide is comprised of a roller about which the stack of sheet stock is folded, allowing ease of movement when individual sheets are removed from the cartridge assembly.

BRIEF DESCRIPTION OF THE DRAWINGS

The invention consists in the novel parts, construction, arrangements, combinations and improvements shown and described. The accompanying drawings which are incorporated in and constitute a part of the specification, illustrate one embodiment of the invention and, together with the description and claims explain the principles of the invention.

DETAILED DESCRIPTION OF THE INVENTION

Reference will now be made in detail to the preferred embodiments of the invention, examples of which are illustrated in the accompanying drawings. Numbers will be repeated between Figures when identifying generally similar elements.

While the invention will be described in connection with a preferred embodiment, it will be understood that it is not intended to limit the invention to that embodiment. On the contrary, it is intended to cover all alternatives, modifications and equivalence as may be included within the spirit and scope of the invention defined by the appended claims.

Figure 1:
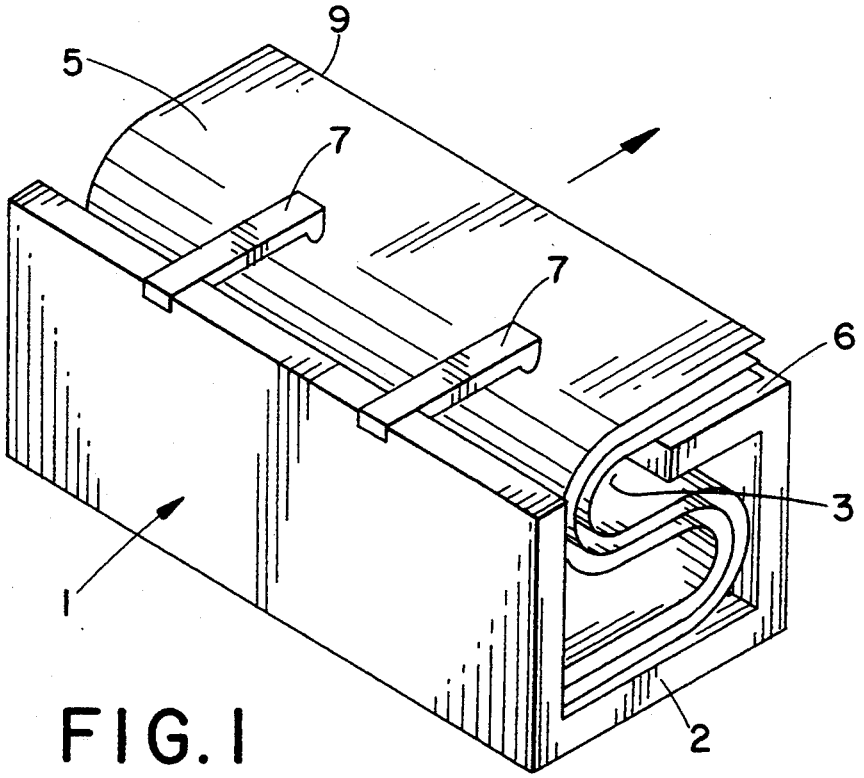
FIG. 1 is a perspective view of a S-shaped cartridge.
Figure 2:
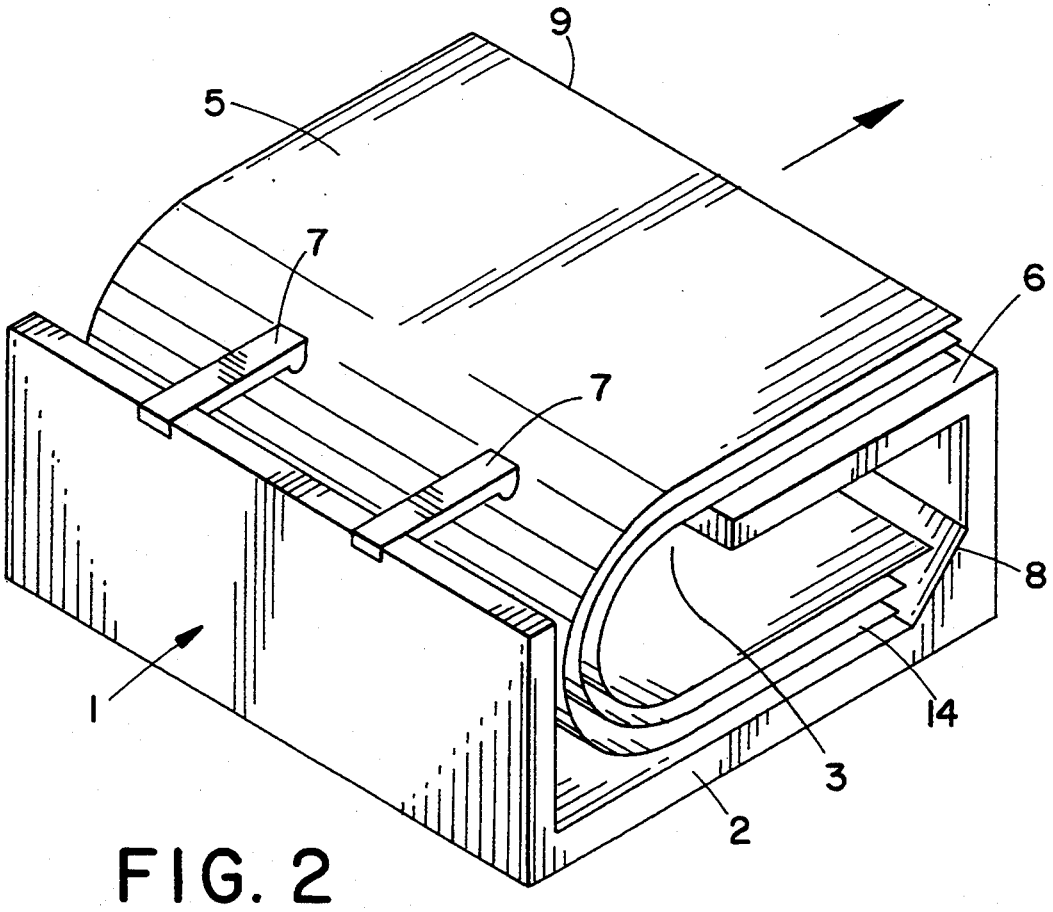
FIG. 2 is a perspective view of a C-shaped cartridge.

Referring now to FIGS. 1 and 2, it can be seen that the cartridge 1 is designed to position a stack of printer or copier stock paper 5 in the feeder tray (not shown) of a printer or copier. It is also apparent that the cartridge 1 facilitates the use of oversized sheets of paper, such as 11"×17" sheets, in a standard sized tray. As utilized herein, standard size generally refers to 8½"×11", 9"×11", 8½"×14", and A4 sized paper. Oversized stock generally refers to "11×17" or A3 sizes. It should be understood that the invention is not limited to these specific paper sizes, in that, it applies to the use of copier or printer paper stock larger than that which can be accommodated by the copier or printer feeder tray. It should also be understood that as utilized herein, length of sheet stock generally refers to the axis of the paper parallel to the machine feed direction. This definition is exemplified in FIG. 5 by "l" which lies parallel to the feed direction.

FIGS. 1 and 2 demonstrate a cartridge housing 2 including an outlet 3 sufficient for passage of sheet stock 5 therethrough. As placed in a tray (not shown), outlet 3 will locate the paper stock 5 on ledge 6 which can be aligned with the discharge opening of the tray to make the sheet stock 5 available to the printer or copier sheet feeding mechanism. The preferably flat ledge 6 provides easy access to a printer or copier sheet feeding mechanism. A tray and sheet feeding mechanism for which cartridge 1 is adaptable is exemplified in U.S. Pat. Nos. 4,589,647; 4,699,369 and 5,079,723 incorporated herein by reference.

As seen in FIGS. 1 and 2, sheet stock 5 is held in cartridge housing 2 in a folded alignment. Preferably, this alignment is achieved by the shape of the cartridge housing 2 in combination with prongs 7. Prongs 7 maintain the sheet stock 5 within cartridge 1 in an aligned and folded position. Prongs 7 are also positioned to allow removal of successive sheets when engaged by the printer or copier sheet feeding mechanism while maintaining alignment of the stack generally. Prongs 7 are positioned to hold down the feed edge 9 and keep the remaining sheets 5 from uncurling into the printer or copier equipment. Preferably, prongs 7 are low friction or spring loaded at the tips. For example, the tip may be a roller, a ratcheted roller, a low friction pad or a curved surface. It should be noted that the terminal end of prongs 7 in contact with the sheet stock 5 are rounded.

Figure 6:
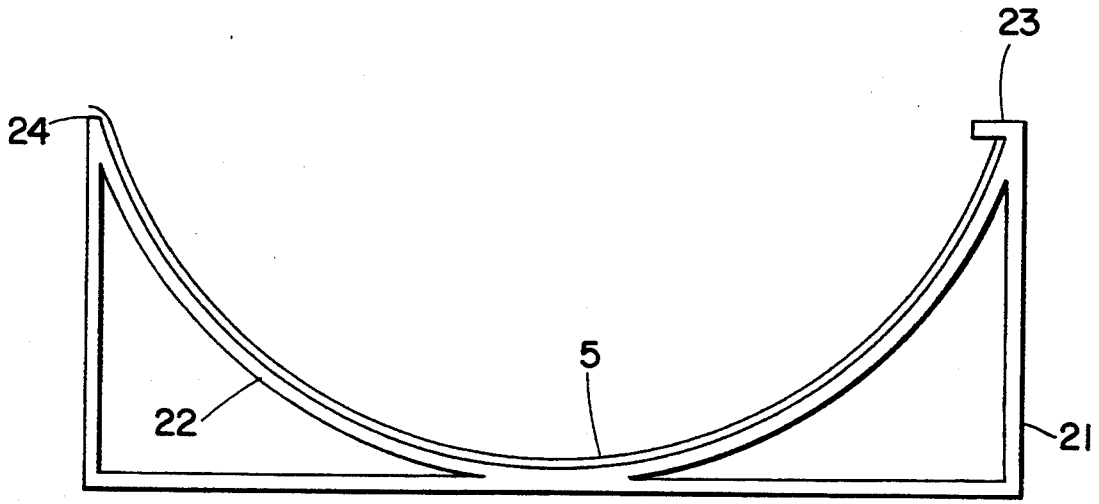
FIG. 6 is a side plan view of a cartridge which reduces the feedstock length by bending.
Figure 7:
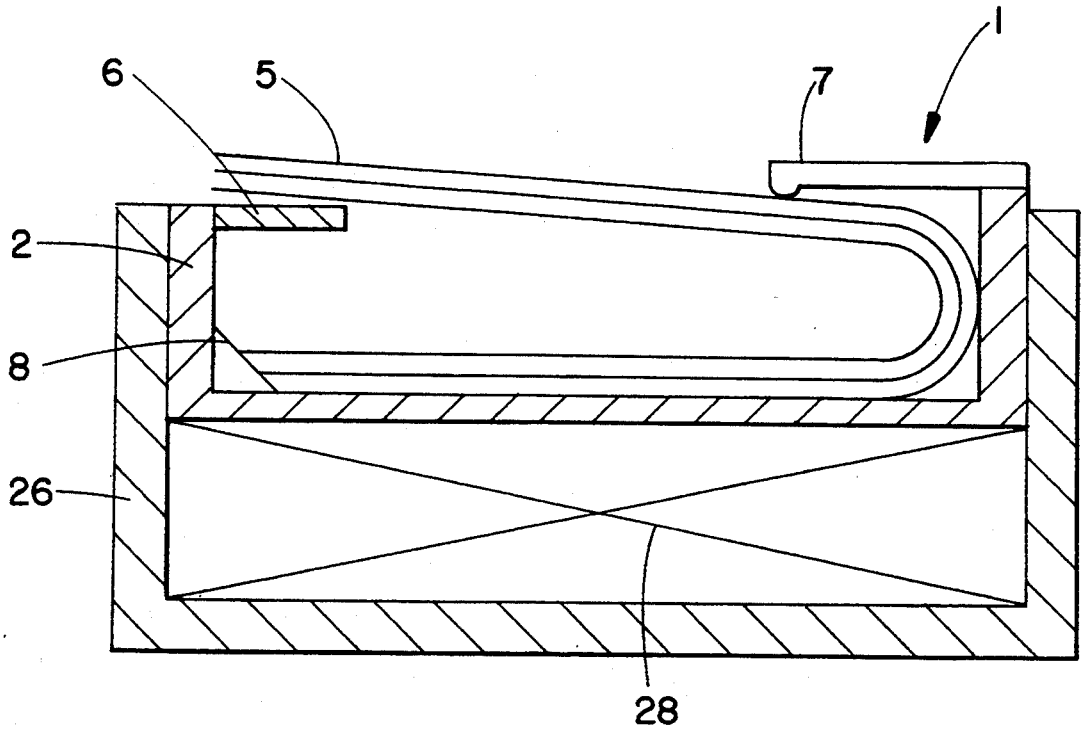
FIG. 7 shows a tray and an elevator mechanism moving the cartridge.

From the side view, the alignment of sheet stock 5 in FIG. 1 demonstrates an S-shape. Accordingly, the cartridge 1 of FIG. 1 is described as an S-shaped cartridge. The cartridge of FIG. 2 is appropriately termed C-shaped. Those of ordinary skill in the art will understand the myriad of shapes and housing designs available to align and hold the paper within the cartridge. All shapes achieving a folded paper stack fall within the intended scope of this invention. A fold, as used herein, generally means at least a partial overlap of at least one sheet by a related portion of the same sheet. It is not necessary that this overlap lead to physical contact of the sheet upon itself as can be seen by the gap or gaps between the layers of paper in FIGS. 1 and 2. Alternatively, the fold may be a roll. From a practical standpoint, the required level of folding must be sufficient to enable the sheet stock and cartridge housing to fit within the available tray. In another embodiment, the paper is curved. This is appropriate when the paper is not significantly longer than the paper tray. Accordingly, a slight bend or curve to the paper stock shortens the required tray length. In this embodiment, FIG. 6, the cartridge 21 includes a shaped or molded portion 22 which holds the paper stock 5 in a curved position. A stop means 23 is optional. Paper stock 5 is removed from cartridge 21 at lip 24.

Figure 3:
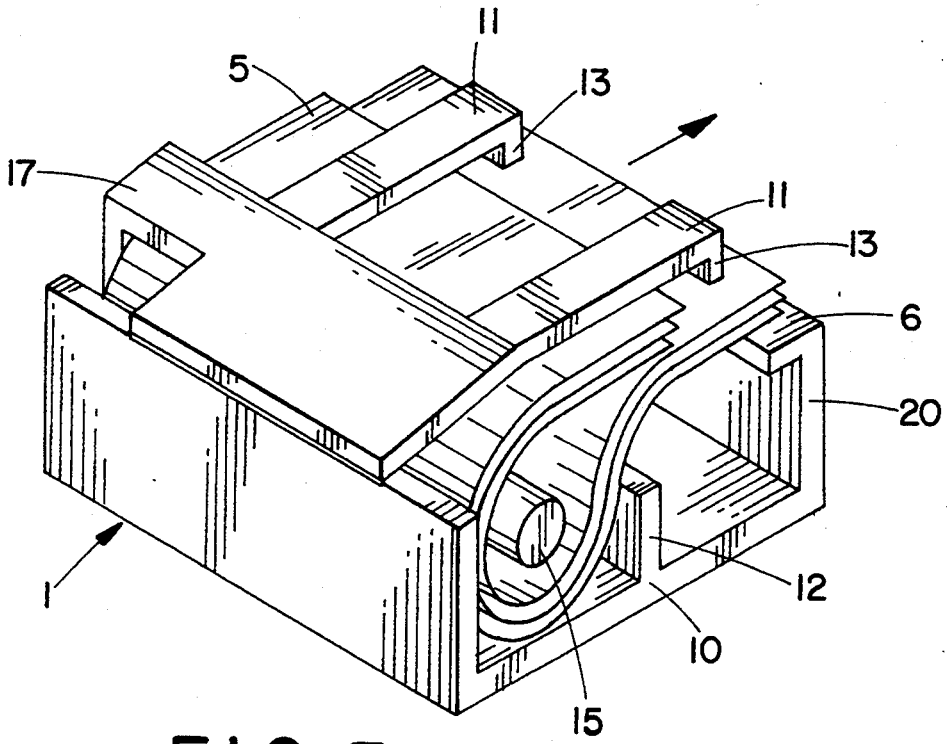
FIG. 3 is a perspective view of a J-shaped cartridge.
Figure 4:
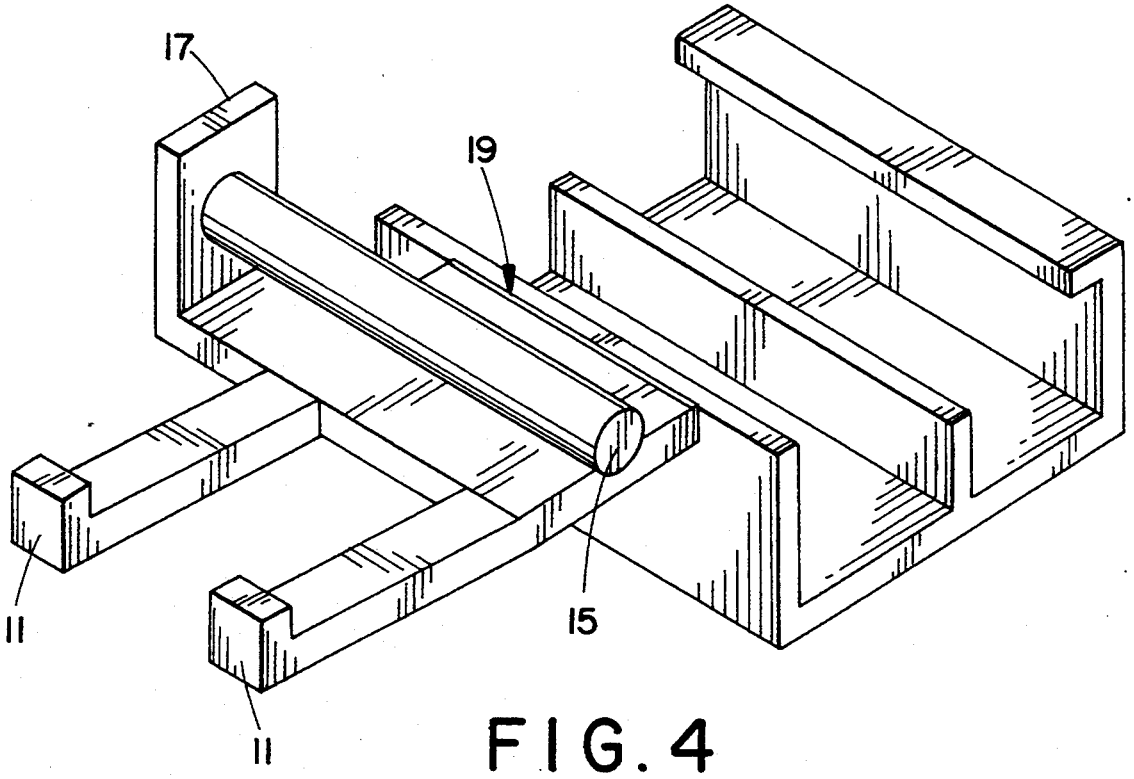
FIG. 4 is a perspective view of the J-shaped cartridge in an opened loading position.

FIG. 3 demonstrates a cartridge 1 having a preferred cartridge housing 10 which forms a J-shaped paper stack 5. The J-shape of FIG. 3 represents an alternative style of cartridge feed, in that, paper exits cartridge 10 from the lower fold of sheet stock 5. This design eliminates friction created by the weight of the uppermost portions of paper stock 5 upon the sheet being withdrawn in the S- and C-shaped cartridges, wherein the weight of the paper upon itself may cause binding at the bend area during withdrawal. FIG. 3 also demonstrates a more elaborate prong mechanism 11 with end means 13. FIG. 3 also shows a preferred roller mechanism 15 for enhancing the folding of the sheets. The roller 15 establishes a low coefficient of friction in sliding sheet stock 5 through cartridge 10 and insures that the trail edge of the sheet stock is kept from being pulled into the feeder mechanism prematurely, causing a misfeed. Roller 15 is attached to prongs 11 via angle bracket 17. As will be apparent to one of ordinary skill in the art, details such as hinges to allow easy opening of the cartridge, mounting mechanism for the internal roller 15, and other design elements are not shown in simplified FIGS. 1-3. FIG. 4 provides a view of the combined angle bracket 17 and roller 15.

Referring back to FIG. 3, cartridge 10 includes upright member 12 located adjacent the roller, running generally axial thereto. Member 12 elevates sheet stock 5, maintaining alignment. Member 12 could be rounded if desired. Alternatively, member 12 could be a curved surface extending from wall 20 to the base of cartridge 10. Member 12 can contact the base anywhere between wall 20 and roller 15. Generally, the curve would be convex to support paper stock 5.

Further preferred embodiments include adding a finger or tab (not shown) on the cartridge to activate the empty switch on the paper tray to indicate when the cartridge is empty. This is necessary because the presence of the cartridge will simulate a full tray.

In another preferred embodiment, FIG. 2 demonstrates a beveled corner 8 within cartridge housing 2. The beveled corner offsets a first edge 14 of sheet stock 5. The feed edge 9, opposite the end abutting the corner, is thereby adjusted for the longer curvature path traveled by the outside of sheet stock 5. This functions to keep feed edge 9 aligned.

Figure 5:
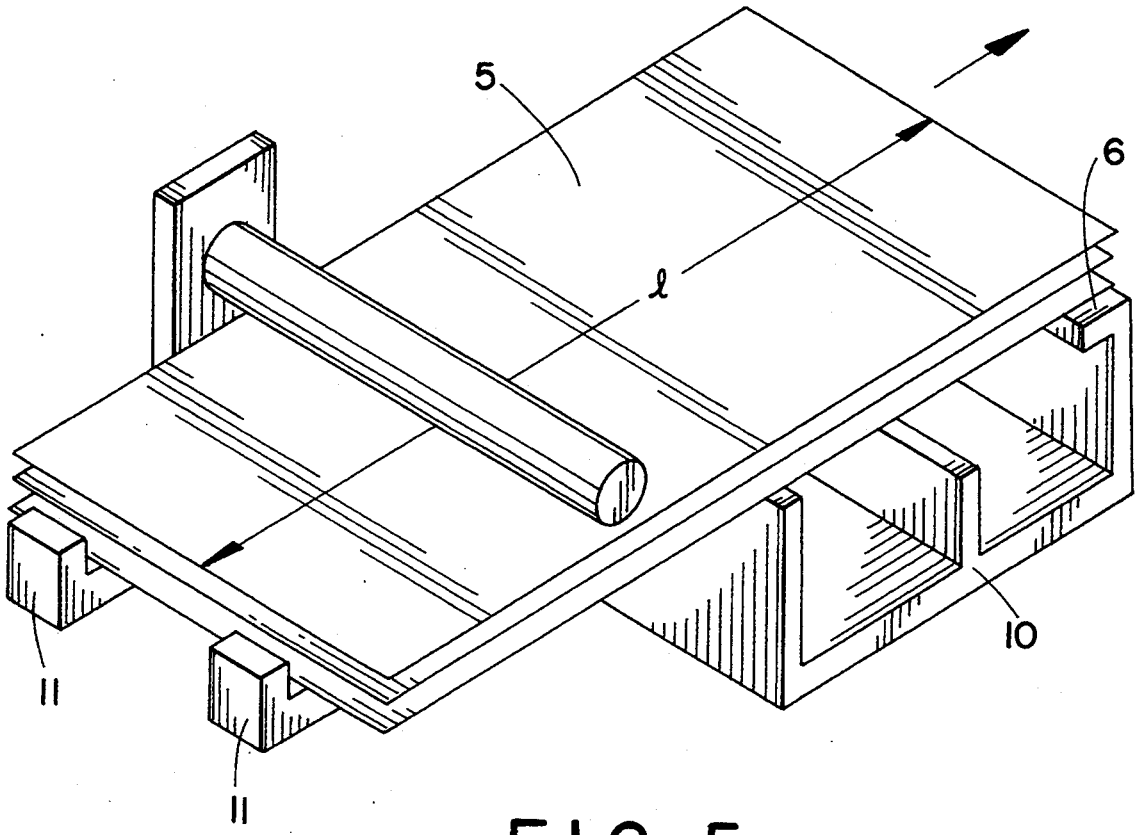
FIG. 5 is a perspective view of the J-shaped cartridge loaded with paper prior to closing.

The loading of a cartridge is particular for each design. For example, the J-cartridge of FIG. 3 would be opened as shown in FIG. 4. Prongs 11 and roller 15 tilt by hinges shown generally at 19 to open the cartridge and allow paper 5 to be laid flat into open cartridge 10 as shown in FIG. 5. In the position of FIG. 5, paper stock 5 is supported by prongs 11 and flat ledge 6. Upon closing, the paper will be folded into the position shown in FIG. 3.

The S and C designs of FIGS. 1 and 2, can also be provided with a opening means to allow easy access for paper loading within the cartridge.

As stated earlier, the cartridge of the current invention is effective in storing sheet stock paper for feed via a tray to a printer or copier. This invention is particularly effective for oversized feed. As apparent from the FIGURES the cartridge significantly decreases the length of the sheet and accordingly the required length of the tray.

Software changes may be required in the copier or printer to enable processing of oversized stock from a standard sized tray. Operator dialogue may also be reprogrammed to enable selection of oversized stock from the standard sized trays. These undertakings are easily within the skill of one of ordinary skill in the art.

The cartridge of this invention provides a low cost alternative to adding a second oversized paper stock tray. Thus, it is apparent that there has been provided, in accordance with the invention, a cartridge that fully satisfies the aims, objects and advantages set forth above. While the invention has been described in conjunction with the specific embodiments thereof, it is evident that many alternatives, modifications and variations will be apparent to those skilled in the art in light of the foregoing description. Accordingly, it is intended to embrace all such alternatives, modifications and variations that fall within the spirit and broad scope of the appended claims.

Having thus described the invention, we claim:

1. In a sheet feeding apparatus of the type having an elevator style, position indexing tray of width "w", height "h", and length " ", adapted to store a stack of sheet stock "S", the storage tray having a discharge opening through which sheets in the stored stack are successively presented to a sheet feeding mechanism, the improvement comprising:

a cartridge assembly removably positioned in the tray and containing an aligned stack of sheet stock "L" of a width less than or equal to "w" and length greater than "1", the cartridge assembly comprising a housing having an outlet opening, individual sheets of the stack of sheet stock "L" passing through the outlet opening during operation of the sheet feeding mechanism while the remainder of the stack of sheet stock "L" remains statically positioned, the stack being folded and enclosed in the housing.

2. The cartridge of claim 1 including means for maintaining the stack in the aligned and folded condition while successive sheets are removed from the stack through the discharge opening.

3. The improvement as defined in claim 2 wherein said means for maintaining the stack comprises at least one prong.

4. The prong of claim 3 having a low friction end.

5. The improvement as defined in claim 3 wherein said at least one prong is functional with a substantially flat ledge axially aligned and adjacent said discharge opening to hold said sheet stock "L" in a planar relationship with said ledge.

6. The improvement as defined in claim 1 wherein the stack of sheet stock "L" is folded upon itself into an S-shape.

7. The improvement as defined in claim 1 wherein the housing includes a guide for maintaining the stack of sheet stock "L" in the folded aligned condition.

8. The improvement as defined in claim 7 wherein the internal guide comprises a roller about which the stack of sheet stock "L" is folded.

9. The improvement as defined in claim 1 wherein the housing includes an inclined wall for engaging a side edge of the folded stack of sheet stock "L".

10. The improvement as defined in claim 1 wherein the stack of sheet stock "L" is folded upon itself into a J-shape.

11. The improvement as defined in claim 10 wherein said cartridge assembly includes at least one prong having means for holding one end of said paper stock.

12. The improvement as defined in claim 1 wherein said cartridge includes means for selective opening.

13. The improvement as defined in claim 12 wherein said means include at least one hinge.

14. The improvement as defined in claim 1 wherein said outlet opening is positioned in the discharge opening of said tray.

15. The improvement as defined in claim 1 wherein the stack of sheet stock "L" is folded upon itself into a C-shape.

16. A cartridge assembly comprising a housing having first and second side walls connected to a base, at least one prong and roller assembly hingedly attached to said first side wall, in a closed position said at least one prong extending toward said second side wall forming an at least partial top to said cartridge assembly, and a ledge member attached to said second side wall, wherein said at least one prong selectively holds at least one paper sheet in contact with said ledge member when said hinge is closed.

17. The cartridge assembly of claim 16 wherein said ledge member is substantially flat and in a parallel plane relationship with said base.

18. The cartridge assembly of claim 16 further comprising a means for supporting said at least one paper sheet positioned between said first and second side walls.

19. The cartridge assembly of claim 18 wherein said means for supporting comprises a vertical member projecting substantially perpendicular from said base between said first and second side walls.

20. The cartridge of claim 16 wherein said first and second side walls define an opening in said cartridge.

21. In a sheet feeding apparatus of the type having an elevator style, position indexing tray of width "w", and length "l", adapted to store a stack of sheet stock "S", the storage tray having a discharge opening through which sheets in the stored stack are successively presented to a sheet feeding mechanism, the improvement comprising:

a cartridge assembly removably positioned in the tray and containing an aligned stack of sheet stock "L" of a width less than or equal to "w" and length greater than "1", the cartridge assembly comprising a housing having a base, at least two side walls, and a stationary rigid member extending from one of said side walls, said member positioning sheet stock "L" substantially parallel to said base in an area adjacent said outlet opening and axially aligned in the area adjacent said outlet opening, the stack of sheet stock "L" being selectively removeable through the outlet opening, the stack being folded and enclosed in the housing.

* * * * *